US007097388B1

(12) United States Patent
Mansour et al.

(10) Patent No.: US 7,097,388 B1
(45) **Date of Patent: *Aug. 29, 2006**

(54) GROUT INJECTING/STRUCTURE ANCHORING SYSTEM

(75) Inventors: Patricia J. Mansour, Tampa, FL (US); Ramzy Moumneh, Tampa, FL (US)

(73) Assignee: GeoJect, Inc., Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/215,895

(22) Filed: Aug. 30, 2005

Related U.S. Application Data

(63) Continuation of application No. 10/811,570, filed on Mar. 29, 2004, which is a continuation-in-part of application No. 10/394,815, filed on Mar. 21, 2003, now Pat. No. 6,821,056.

(51) Int. Cl.
*E02D 5/00* (2006.01)
*E02D 17/02* (2006.01)

(52) U.S. Cl. ..... 405/230; 405/235; 405/238; 405/240; 405/244; 52/125.1

(58) Field of Classification Search ..... 405/230–233, 405/235, 238, 240, 244, 249, 267, 269; 52/125.1, 52/126.1, 126.5–126.6, 292
See application file for complete search history.

(56) References Cited

U.S. PATENT DOCUMENTS

| | | | | | |
|---|---|---|---|---|---|
| 2,080,406 | A | * | 5/1937 | Allen | 405/249 |
| 2,403,643 | A | * | 7/1946 | Dresser | 405/267 |
| 3,243,962 | A | | 4/1966 | Ratliff | 405/266 |
| 3,483,707 | A | * | 12/1969 | Meheen | 405/211 |
| 3,796,055 | A | | 3/1974 | Mahoney | 254/29 R |
| 3,807,184 | A | * | 4/1974 | Turzillo | 405/238 |
| 4,018,056 | A | * | 4/1977 | Poma | 405/233 |
| 4,507,069 | A | | 3/1985 | Murray et al. | 52/125.1 |
| 4,591,466 | A | | 5/1986 | Murray et al. | 405/230 |
| 4,618,289 | A | * | 10/1986 | Federer | 405/236 |
| 4,673,315 | A | | 6/1987 | Shaw et al. | 405/230 |
| 4,678,373 | A | * | 7/1987 | Langenbach, Jr. | 405/230 |
| 4,695,203 | A | | 9/1987 | Gregory | 254/29 R |
| 4,948,301 | A | * | 8/1990 | Geffriaud et al. | 405/244 |
| 4,997,314 | A | | 3/1991 | Hartman | 405/233 |
| 5,013,190 | A | | 5/1991 | Green | 405/230 |
| 5,018,905 | A | | 5/1991 | Kinder | 405/230 |
| 5,123,209 | A | | 6/1992 | Nally | 405/230 |
| 5,176,472 | A | | 1/1993 | Kinder | 405/230 |
| 5,482,407 | A | | 1/1996 | Raaf | 405/230 |
| 5,492,437 | A | | 2/1996 | Ortiz | 405/230 |

(Continued)

FOREIGN PATENT DOCUMENTS

| | | | | |
|---|---|---|---|---|
| JP | 55072511 | * | 5/1980 | 405/267 |

*Primary Examiner*—Jong-Suk (James) Lee
(74) *Attorney, Agent, or Firm*—John E. Burke; Greenberg Traurig

(57) ABSTRACT

A grout injecting/structure anchoring system has a support bracket with a horizontal portion and a pair of threaded recesses and a sleeve there between. A grout tube has a plurality of apertures along its length. A lower cross brace is positioned above the sleeve and guide tube and grout tube with unthreaded holes axially aligned with the threaded recesses of the support bracket. The lower cross brace has associated there with threaded cylinders with lower ends coupled to the threaded recesses and upper ends extending through the unthreaded holes. Nuts are received by the upper ends of the threaded cylinders above the lower cross brace. The nuts are adapted to be rotated for raising the support bracket.

13 Claims, 7 Drawing Sheets

U.S. PATENT DOCUMENTS 5,904,447 A * 5/1999 Sutton et al. ..... 405/263
5,919,005 A * 7/1999 Rupiper ..... 405/244
5,934,836 A 8/1999 Rupiper et al. ..... 405/244
6,142,710 A * 11/2000 Holland et al. ..... 405/230
6,468,002 B1 10/2002 Gregory et al. ..... 405/230
6,478,512 B1 * 11/2002 Sherwood ..... 405/232
6,503,024 B1 1/2003 Rupiper ..... 405/230
6,514,012 B1 2/2003 Gregory et al. ..... 405/230
6,722,821 B1 * 4/2004 Perko et al. ..... 405/249
6,821,056 B1 * 11/2004 Mansour ..... 405/230

* cited by examiner

GROUT INJECTING/STRUCTURE ANCHORING SYSTEM

RELATED APPLICATION

This application is a continuation application of U.S. patent application Ser. No. 10/811,570 filed Mar. 29, 2004, which is a continuation-in-part application of U.S. patent application Ser. No. 10/394,815 filed Mar. 21, 2003, now U.S. Pat. No. 6,821,056.

BACKGROUND OF THE INVENTION

1. Field of the Invention

The present invention relates to a grout injecting/structure anchoring system and more particularly pertains to solidifying a structure by supporting it from bedrock and filling any subterranean voids which would otherwise cause structural instability.

2. Description of the Prior Art

The use of structural supports and stabilizers is known in the prior art. More specifically, structural supports and stabilizers previously devised and utilized for the purpose of supporting and stabilizing structures through known methods and apparatuses are known to consist basically of familiar, expected, and obvious structural configurations, notwithstanding the myriad of designs encompassed by the crowded prior art which has been developed for the fulfillment of countless objectives and requirements.

| U.S. Pat. No. | Issue Date | Inventor | Title |
|---|---|---|---|
| 4,507,069 | Mar. 26, 1985 | Murray et al. | APPARATUS FOR POSITIONING AND STABILIZING A CONCRETE SLAB |
| 4,695,203 | Sep. 22, 1987 | Gregory | METHOD AND APPARATUS FOR SHORING AND SUPPORTING A BUILDING FOUNDATION |
| 4,673,315 | Jun. 16, 1987 | Shaw et al. | APPARATUS FOR RAISING AND SUPPORTING A BUILDING |
| 5,018,905 | May 28, 1991 | Kinder | FOUNDATION SHORING METHOD AND MEANS |
| 6,468,002 | Oct. 22, 2002 | Gregory et al. | FOUNDATION SUPPORTING AND LIFTING SYSTEM AND METHOD |
| 6,514,012 | Feb. 4, 2003 | Gregory et al. | SYSTEM AND METHOD FOR RAISING AND SUPPORTING A BUILDING AND CONNECTING ELONGATED FILING SECTIONS |
| 4,591,466 | May 27, 1986 | Murray et al. | METHOD FOR POSITIONING AND STABILIZING A CONCRETE SLAB |

While these devices fulfill their respective, particular objectives and requirements, the aforementioned patents do not describe a grout injecting/structure anchoring system that allows solidifying a structure by supporting it from bedrock and filling any subterranean voids which would otherwise cause structural instability.

In this respect, the grout injecting/structure anchoring system according to the present invention substantially departs from the conventional concepts and designs of the prior art, and in doing so provides an apparatus primarily developed for the purpose of solidifying a structure by supporting it from bedrock and filling any subterranean voids which would otherwise cause structural instability.

Therefore, it can be appreciated that there exists a continuing need for a new and improved grout injecting/structure anchoring system which can be used for solidifying a structure by supporting it from bedrock and filling any subterranean voids which would otherwise cause structural instability. In this regard, the present invention substantially fulfills this need.

SUMMARY OF THE INVENTION

In view of the foregoing disadvantages inherent in the known types of structural supports and stabilizers now present in the prior art, the present invention provides an improved grout injecting/structure anchoring system. As such, the general purpose of the present invention, which will be described subsequently in greater detail, is to provide a new and improved grout injecting/structure anchoring system and method which has all the advantages of the prior art and none of the disadvantages.

To attain this, the present invention essentially comprises a structure, such as a house on a foundation. The structure is susceptible to instability. The instability is due to any subterranean voids. The structure has a foundation. The foundation is positionable on soil over bedrock.

A hollow cylindrical supportive tube is provided next. The supportive tube has a first inner diameter. The supportive tube is adapted to be inserted into soil adjacent to the foundation of the structure and through any subterranean void. The supportive tube has a closed bottom end. The closed bottom end is provided with a cap. The closed bottom end is firmly abutted to bedrock. The supportive tube has an open top end. The open top end is positioned adjacent to the foundation of the structure. The supportive tube further has a linear body between the top end and the bottom end. A plurality of equally spaced circular apertures is provided along the length of the linear body and around its circumference.

A supplemental tube is slidably positioned within the grout tube.

Further provided is an L-shaped support bracket. The support bracket is adapted to be securely placed under a foundation of a structure. The support bracket has a weight bearing horizontal portion. The weight bearing horizontal portion is adapted to support the foundation. The support bracket also has an aligning vertical portion. The aligning vertical portion has a pair of apertures. The apertures have horizontal bolts. The bolts are adapted to couple the support bracket to the foundation. The support bracket has adjusting elements. The adjusting elements include vertically oriented internally threaded sleeves. The adjusting elements further include a vertically oriented unthreaded sleeve. A cross brace and vertical bolts are provided. Each bolt has an upper nut. The support bracket is adapted to hold the foundation at a level desired by a user.

Provided last is a grout dispensing unit. The grout dispensing unit is coupled to the upper end of the filling tube and is for dispensing grout through the apertures of the tube beginning adjacent to the lower end. This allows grout to pass through the apertures of the tube and fill subterranean voids. This filling of the tube and the subterranean void thereby function to solidify the supportive tube. This further produces a massive anchoring flange of the filled subterranean void and is coupled to the supportive tube to add further support to the building structure.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved grout injecting/structure anchoring system which has all of the advantages of the prior art structural supports and stabilizers and none of the disadvantages.

It is another object of the present invention to provide a new and improved grout injecting/structure anchoring system which may be easily and efficiently manufactured and marketed.

It is further an object of the present invention to provide a new and improved grout injecting/structure anchoring system which is of durable and reliable constructions.

An even further object of the present invention is to provide a new and improved grout injecting/structure anchoring system which is susceptible of a low cost of manufacture with regard to both materials and labor, and which accordingly is then susceptible of low prices of sale to the consuming public, thereby making such grout injecting/structure anchoring system economically available to the buying public.

Even still another object of the present invention is to provide a grout injecting/structure anchoring system for solidifying a structure by supporting it from bedrock and filling any subterranean voids which would otherwise cause structural instability.

Lastly, it is an object of the present invention to provide a new and improved grout injecting/structure anchoring system. The system has a support bracket with a horizontal portion and a pair of threaded recesses and a sleeve there between. A grout tube has a plurality of apertures along its length. A lower cross brace is positioned above the sleeve and grout tube with unthreaded holes axially aligned with the threaded recesses of the support bracket. The lower cross brace has associated there with threaded cylinders with lower ends coupled to the threaded recesses and upper ends extending through the unthreaded holes. Nuts are received by the upper ends of the threaded cylinders above the lower cross brace. The nuts are adapted to be rotated for raising the support bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated and described the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
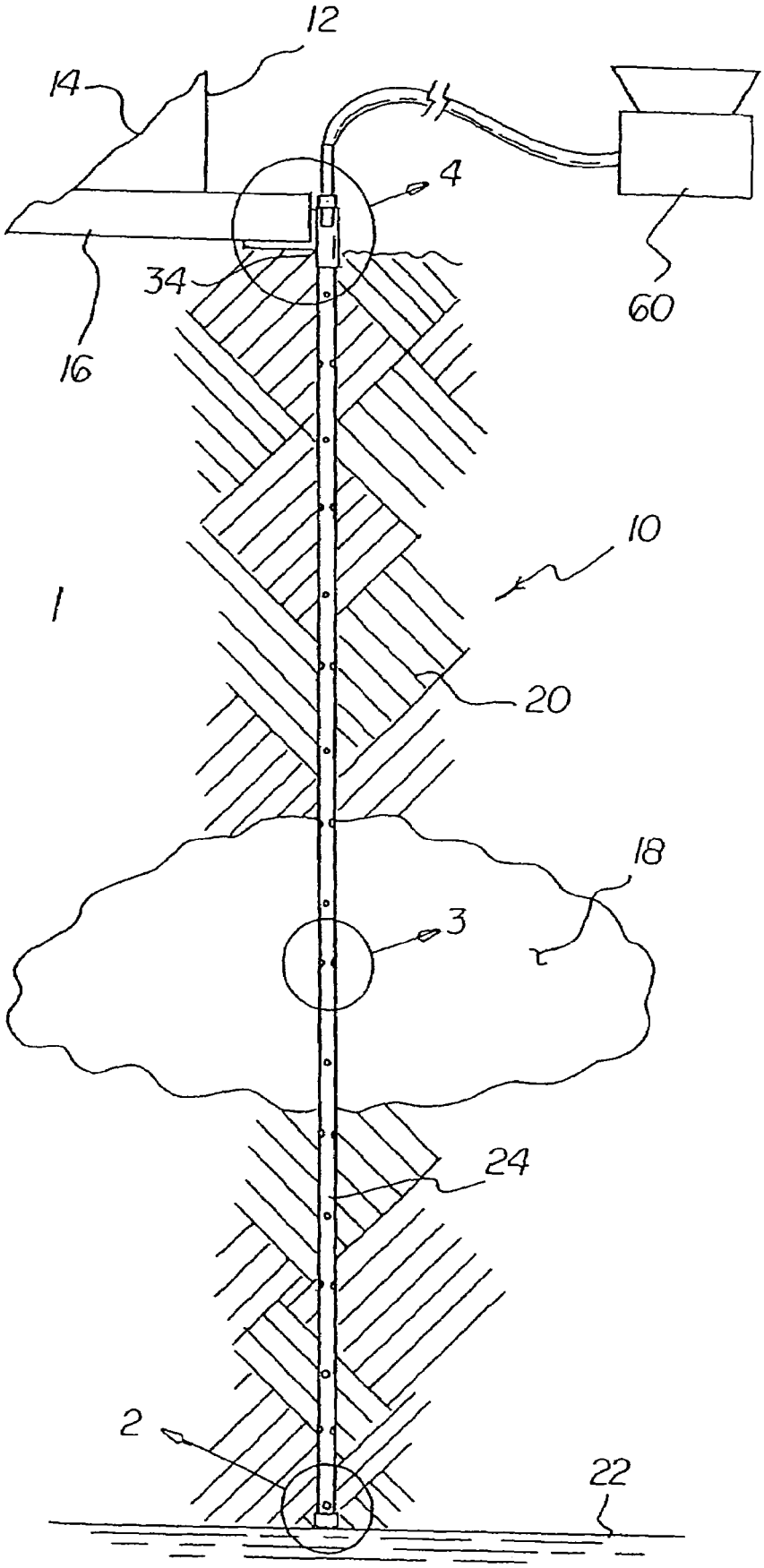
FIG. 1 is a side elevational view, partly in cross section, showing the grout injecting/structure anchoring system constructed in accordance with the principles of the present invention.
Figure 2:
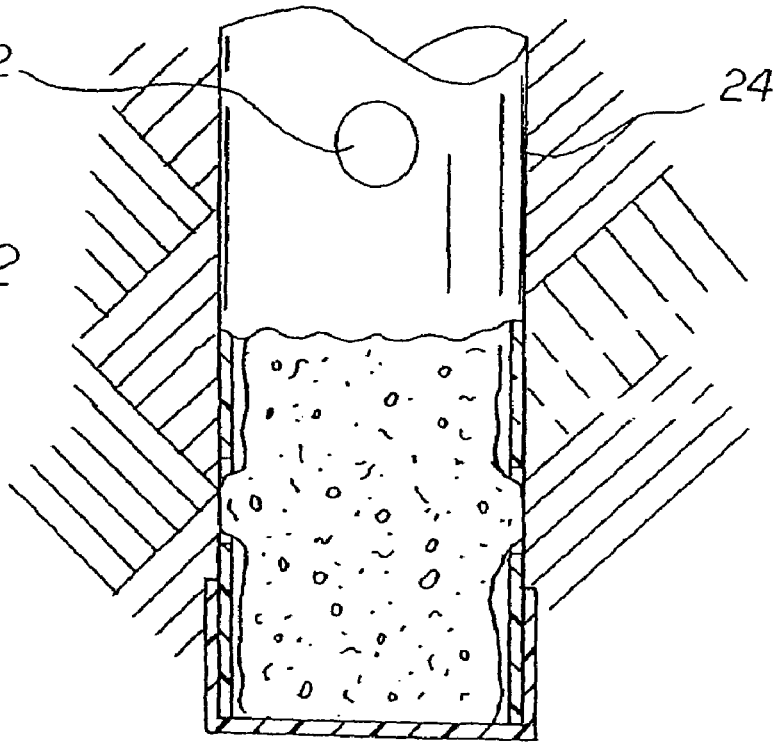
FIG. 2 is an enlarged cross sectional view of the system taken at circle 2 of FIG. 1, the view being a the initiating of the injection process.
Figure 3:
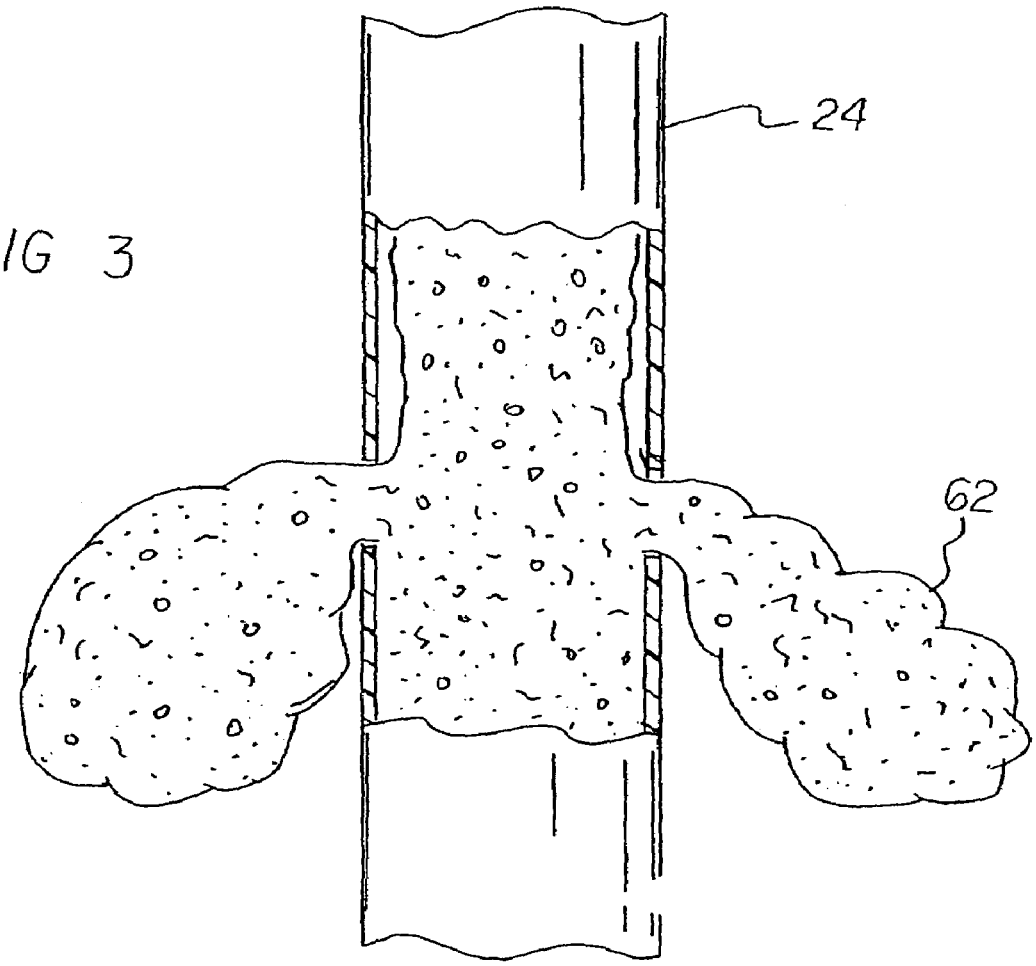
FIG. 3 is an enlarged cross sectional view of the system taken at circle 3 of FIG. 1, the view being an intermediate point of the injection process.
Figure 4:
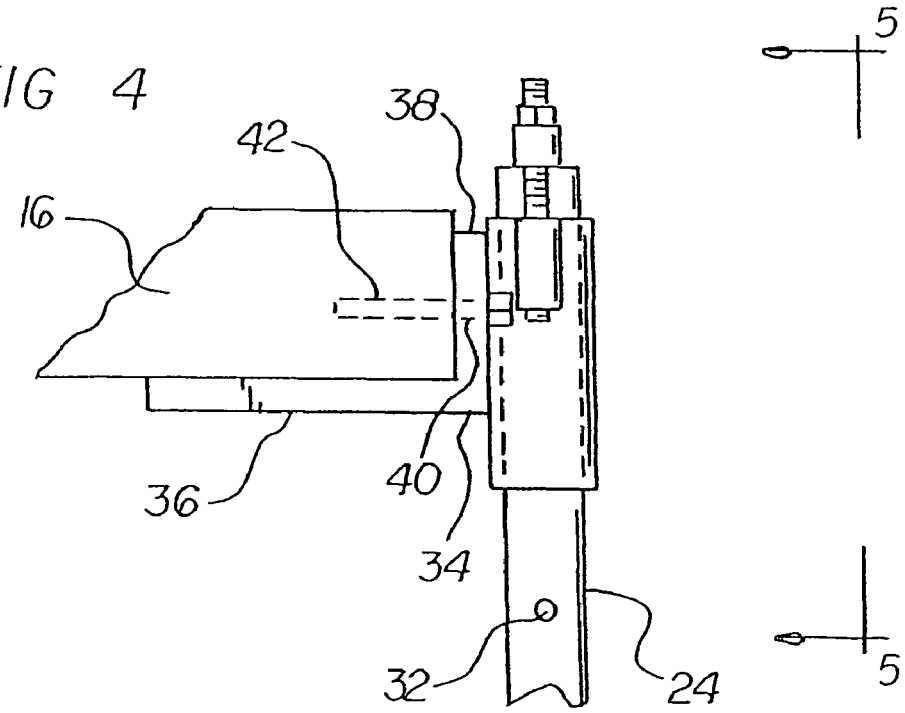
FIG. 4 is an enlarged cross sectional view of the system taken at circle 4 of FIG. 1.
Figure 5:
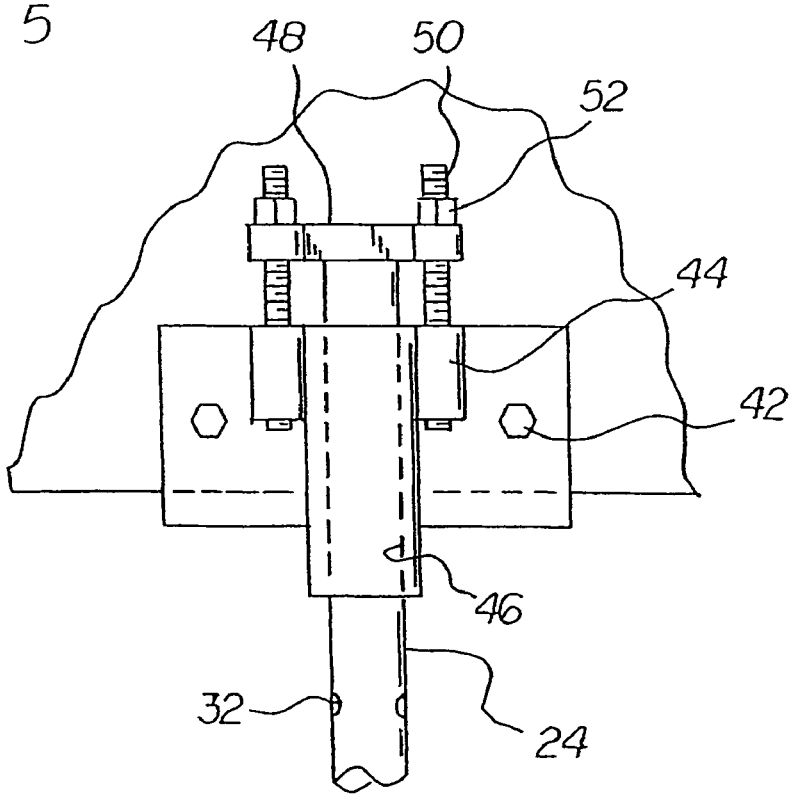
FIG. 5 is a side elevational view taken at line 5—5 of FIG. 4.
Figure 6:
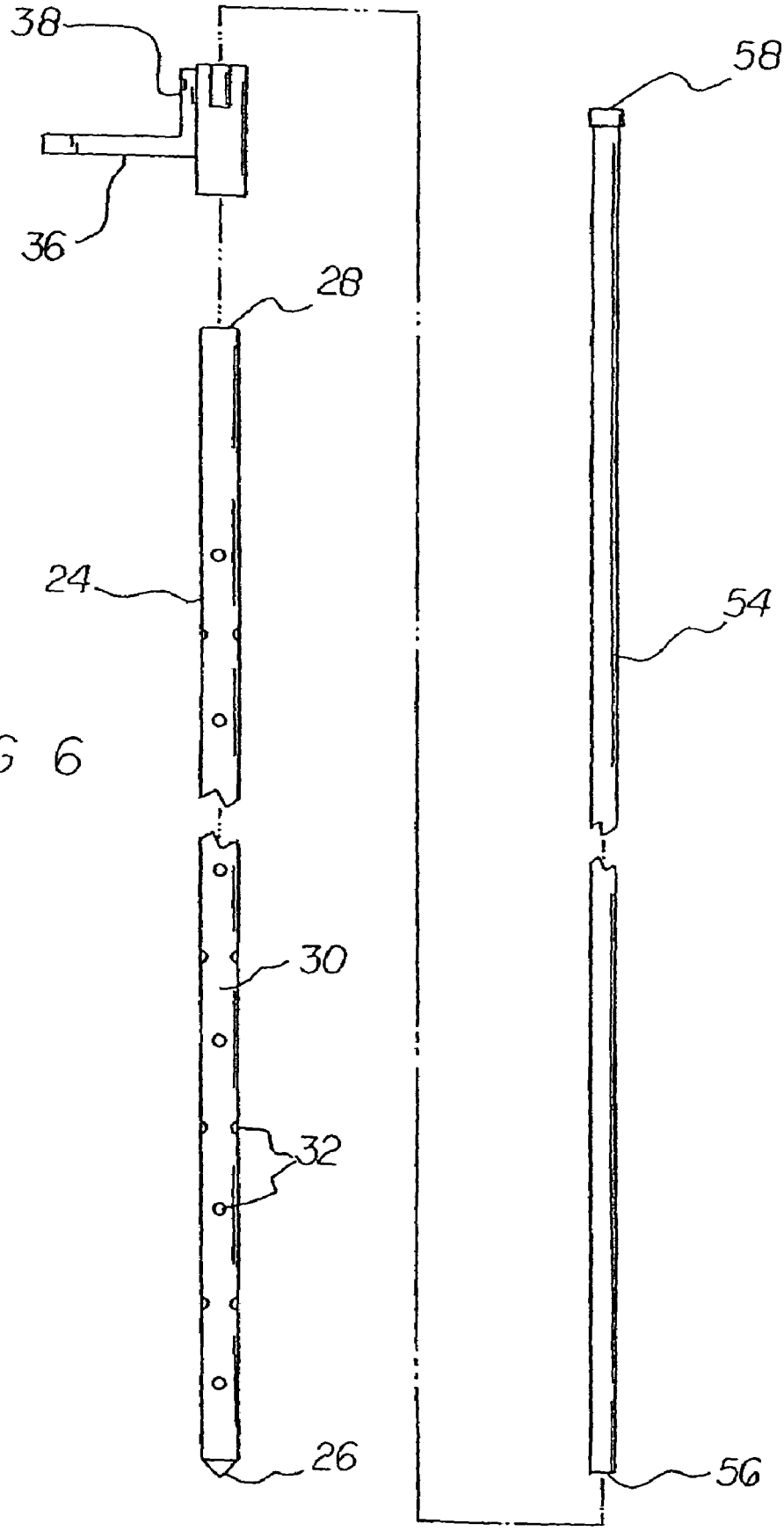
FIG. 6 is an exploded side elevational view of the system of the prior Figures.
Figure 7:
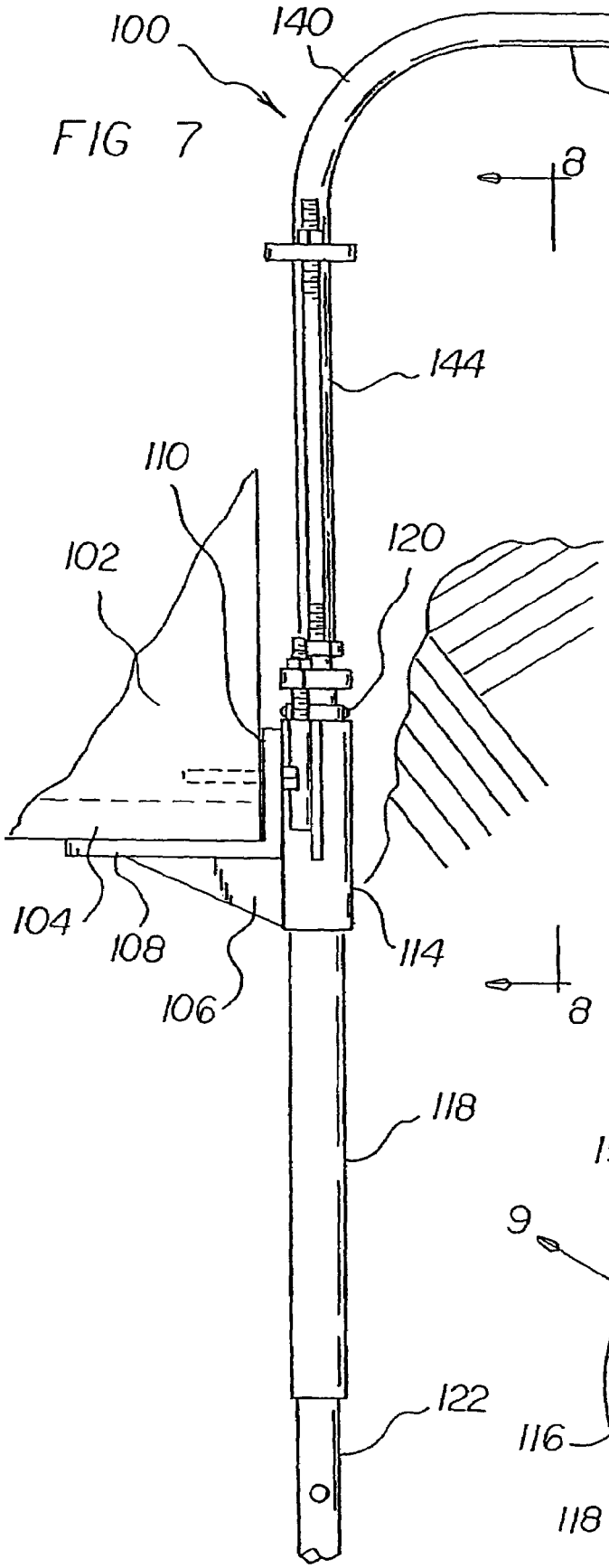
FIG. 7 is a side elevational view similar to FIG. 1 but illustrating an alternate embodiment of the invention.
Figure 8:
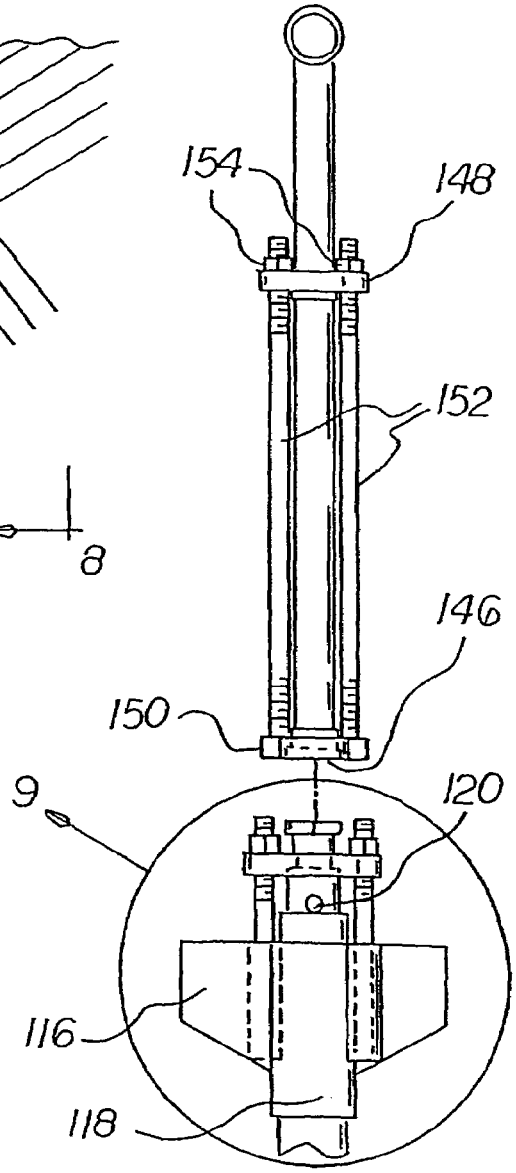
FIG. 8 is a front elevational view taken along line 8—8 of FIG. 7.
Figure 9:
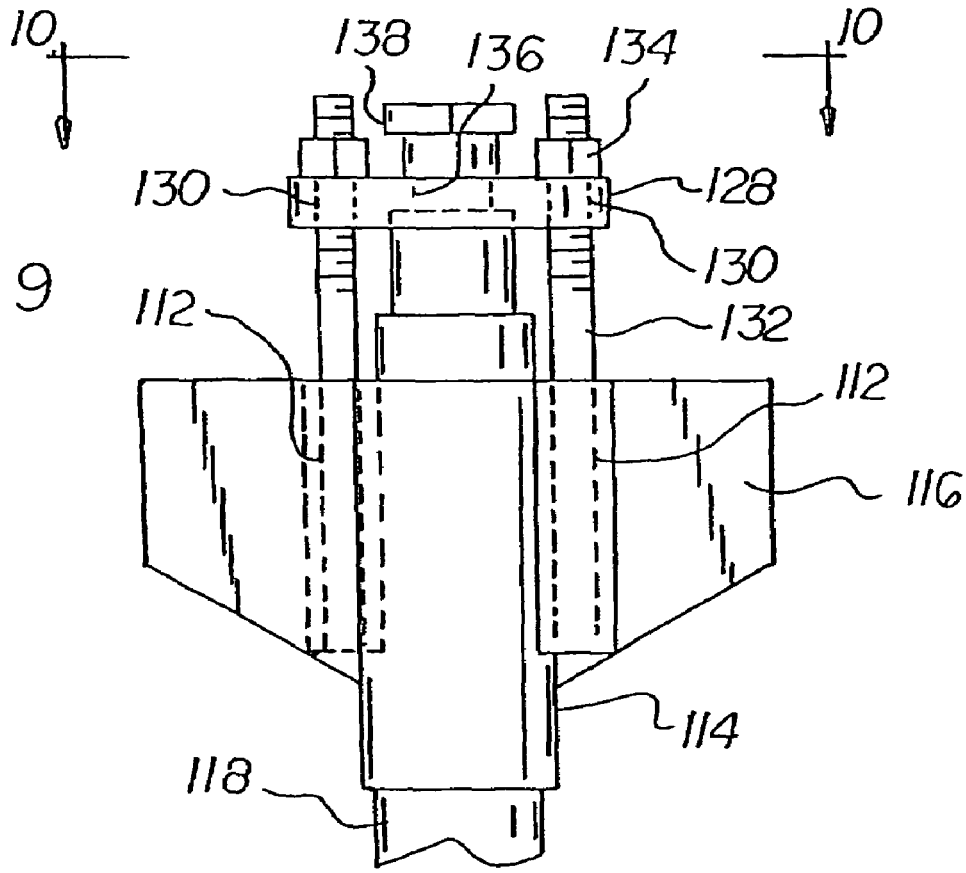
FIG. 9 is an enlarged front elevational view taken at circle 9 of FIG. 8.
Figure 10:
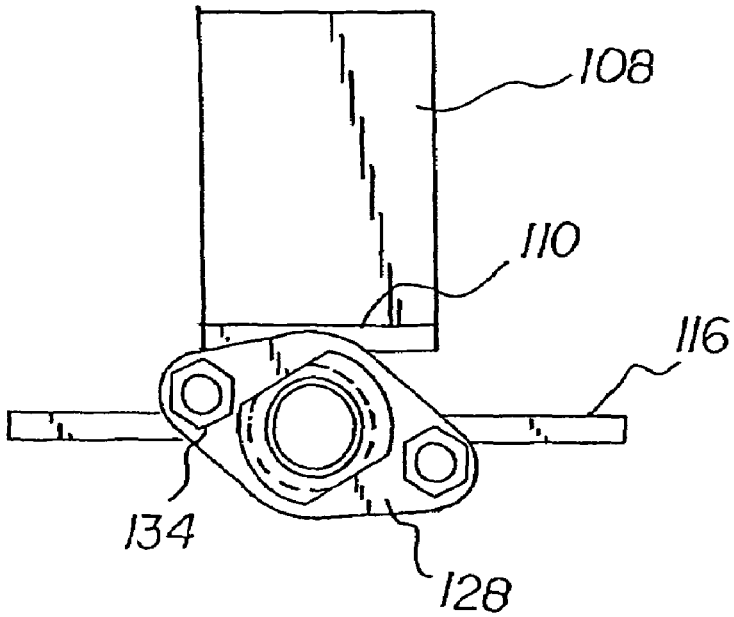
FIG. 10 is an enlarged plan view taken along line 10—10 of FIG. 9.
Figure 11:
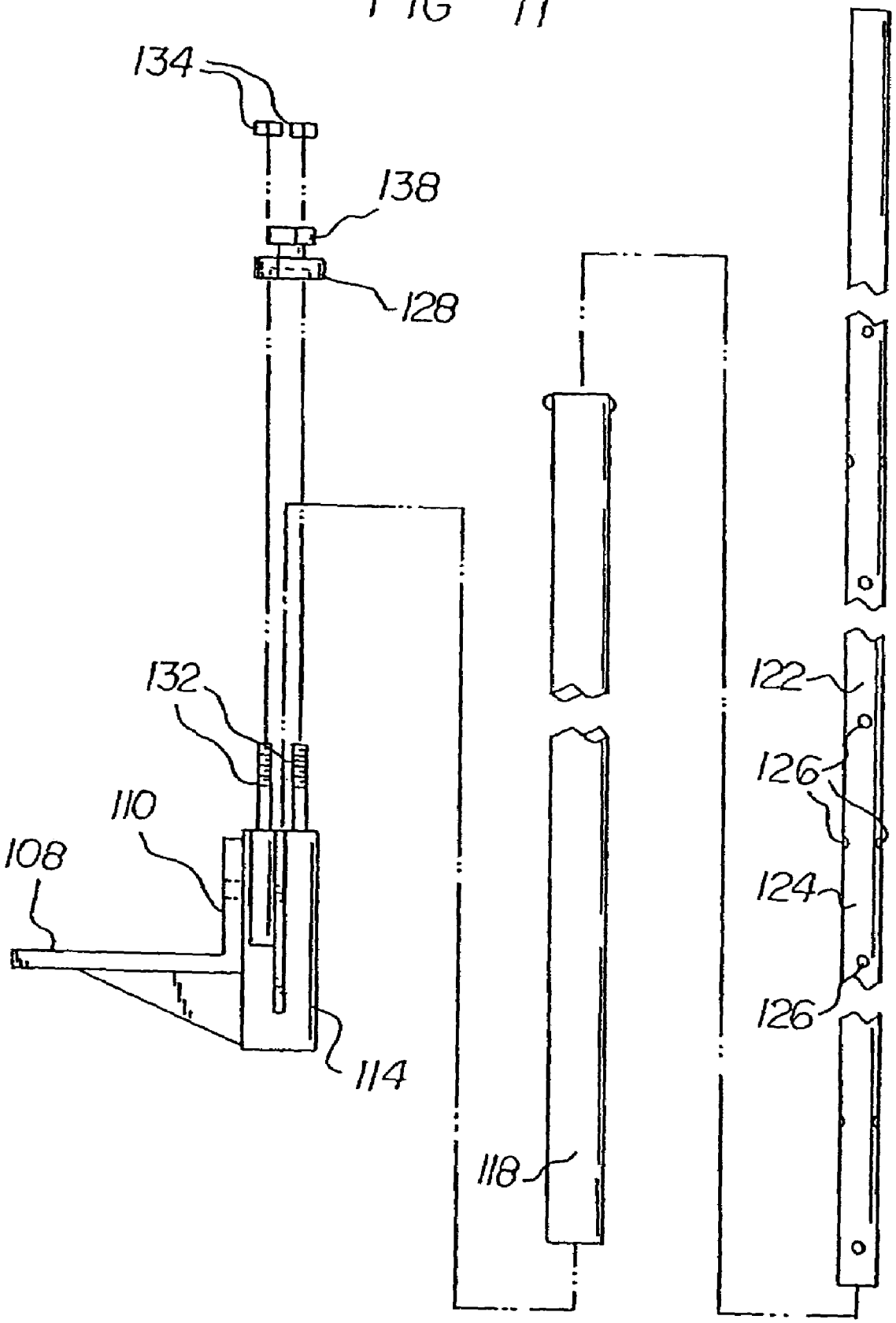
FIG. 11 is an exploded side elevational view of the system of FIGS. 7 through 10.

With reference now to the drawings, and in particular to FIG. 1 thereof, the preferred embodiment of the new and improved grout injecting/structure anchoring system embodying the principles and concepts of the present invention and generally designated by the reference numeral 10 will be described.

The present invention, the grout injecting/structure anchoring system 10 is comprised of a plurality of components. Such components in their broadest context include a structure, a hollow cylindrical supportive tube, a bracket, and a hollow cylindrical filling tube. Such components are individually configured and correlated with respect to each other so as to attain the desired objective.

First provided is a structure 12, such as a house 14 on a foundation 16. The structure is susceptible to instability. The instability is due to any subterranean voids 18. The structure has a foundation 16. The foundation is positionable on soil 20 over bedrock 22.

A hollow cylindrical supportive tube 24 is provided next. The supportive tube has a first inner diameter. The supportive tube is adapted to be inserted into soil adjacent to the foundation of the structure and through any subterranean void. The supportive tube has a closed bottom end 26. The closed bottom end is provided with a cap. The closed bottom end is firmly abutted to bedrock. The supportive tube has an open top end 28. The open top end is positioned adjacent to the foundation of the structure. The supportive tube further has a linear body 30 between the top end and the bottom end. A plurality of equally spaced circular apertures 32 is provided along the length of the linear body and around its circumference.

Further provided is an L-shaped support bracket 34. The support bracket is adapted to be securely placed under a foundation of a structure. The support bracket has a weight bearing horizontal portion 36. The weight bearing horizontal portion is adapted to support the foundation. The support bracket also has an aligning vertical portion 38. The aligning vertical portion has a pair of apertures 40. The apertures have horizontal bolts 42. The bolts are adapted to couple the support bracket to the foundation. The support bracket has adjusting elements. The adjusting elements include vertically oriented internally threaded sleeves 44. The adjusting elements further include a vertically oriented unthreaded sleeve 46. A cross brace 48 and vertical bolts 50 are provided. Each bolt has an upper nut 52. The support bracket is adapted to hold the foundation at a level desired by a user.

A hollow supplemental tube 54 is slidably positioned within the grout tube. The supplemental tune is imperforate and has a lower end 56 and an upper end 58. By raising the supplemental tube while pumping grout, the filling of voids adjacent to the lower regions prior to the filling of voids adjacent to the upper regions is insured.

Provided last is a pressurized grout dispensing unit 60. The grout dispensing unit is coupled to the upper end of the tube for dispensing grout 62 through the tube beginning adjacent to the lower end of the tube. The lower end of the tube is adjacent to the bedrock. Grout is thus allowed to pass through the apertures of the supportive tube and fill any subterranean void. This filling of the tube and subterranean void thereby function to solidify the supportive tube. This further produces a massive anchoring flange of the filled subterranean void and is coupled to the supportive tube to add further support to the building structure.

An alternate embodiment of the invention is illustrated in FIGS. 7 through 11. In such embodiment, there is disclosed a grout injecting/structure anchoring system 100 for solidifying a structure by supporting it from bedrock and filling any subterranean voids which would otherwise cause structural instability. The system comprises, in combination, a structure 102 susceptible to instability due to any subterranean voids. The structure has a foundation 104 positionable on soil over bedrock. An L-shaped support bracket 106 is adapted to be securely placed under a foundation of a structure with a weight bearing horizontal portion 108 adapted to support the foundation and an aligning vertical portion 110. The aligning vertical portion has a pair of vertically oriented internally threaded recesses 112 and a vertically oriented unthreaded short sleeve 114 there between. The short sleeve has laterally extending vertical wings 116. The short sleeve also has an axial length with an upper end and a lower end and an internal diameter.

An intermediate guide tube 118 has an axial length greater than the axial length of the short sleeve. The guide tube has an internal diameter and an external diameter slightly less than the internal diameter of the short sleeve. The guide tube has a lower end and an upper end with a radial projection 120 there adjacent. As such, the guide tube may be slidably received within the short sleeve from its upper end but be limited in its downward movement by the projection contacting the upper end of the short sleeve.

A hollow cylindrical supportive grout tube 122 has an axial length greater than the axial length of the guide tube. The grout tube has an internal diameter and an external diameter slightly less than the internal diameter of the guide tube. The grout tube has a closed lower end and an open upper end. As such, the grout tube may be slidably received within the guide tube. The grout tube further has a linear body 124 between its upper and lower ends and with a plurality of equally spaced circular apertures 126 along the length of the linear body and around its circumference.

A lower cross brace 128 is positioned above the short sleeve and guide tube and grout tube with unthreaded holes 130 axially aligned with the threaded recesses of the support bracket. The lower cross brace has associated there with threaded cylinders 132 with lower ends coupled to the threaded recesses and upper ends extending through the unthreaded holes. Nuts 134 are received by the upper ends of the threaded cylinders above the lower cross brace. The nuts are adapted to be rotated for raising the foundation and structure. The lower cross brace also has a central opening 136 for the flow of grout there through. It also has an upwardly extending collar 138.

A pressurized grout dispensing unit 140 has a horizontal section 142 and a vertical coupling section 144 with a lower end 146. It is adapted to releasably coupled to the upwardly extending collar of the lower cross brace.

Securement components include an upper cross brace 148 receiving at the upper end of the vertical coupling section with two laterally spaced unthreaded bores. An intermediate cross brace 150 is received at the lower end of the vertical coupling section with two laterally spaced threaded bores axially aligned with the unthreaded bores of the upper cross brace. Two elongated threaded rods 152 are coupled to the threaded bores and extend upwardly through the unthreaded bores. Nuts 154 are above the upper cross brace to secure the vertical coupling section to the collar of the lower cross brace.

The collar of the lower cross brace is coupled to the intermediate cross brace so as to preclude upward movement of the intermediate cross brace. The upper cross brace is coupled to an enlargement of the vertical coupling section so as to preclude downward movement of the upper cross brace with respect to the enlargement. As such, tightening of the nuts will increase the seal between the lower end of the dispensing unit onto the lower cross brace and grout tube.

The system is adapted to dispense grout thereby allowing grout to pass through the apertures of the grout tube and fill any subterranean voids. This filling of the tube and subterranean voids thereby functions to solidify the grout tube and produce a massive anchoring flange of the filled subterranean void which is coupled to the grout tube to thereby add further support to the building structure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A grout injecting/structure anchoring apparatus for solidifying or supporting a structure, the apparatus comprising:

(a) a grout tube, the grout tube having linear body and a closed lower end and an open upper end, and a plurality of apertures along the length of the linear body;

(b) a bracket adjustably affixed near an upper portion of said grout tube, said bracket being adapted to be attached to the structure;

(c) a supplemental tube having a lower end and an upper end, the lower end being capable of insertion into the upper end of the grout tube and being adjustably slidably positioned along the axial length of, and within the inside diameter of the grout tube; and (d) a grout dispensing unit adapted to be releasably coupled to the upper end of the supplemental tube.

2. The apparatus of claim 1 wherein said bracket comprises a horizontal portion and a vertical portion; said horizontal portion being adapted to support the foundation; and said vertical portion having a pair of apertures, each aperture having a horizontal bolt adapted to couple the bracket to the foundation.

3. The apparatus of claim 2 wherein said vertical portion comprises adjustable elements comprising a pair of vertically oriented internally threaded sleeves and a vertically oriented sleeve located between said threaded sleeves for receipt of the grout tube.

4. The apparatus of claim 3 wherein said bracket further comprises a cross brace located above the vertical portion, said cross brace having a pair of apertures, each aperture axially aligned with one of the threaded sleeves; and a pair of bolts each located vertically through one of said threaded sleeves and one of said apertures, each bolt having a nut.

5. The apparatus of claim 1 wherein the apparatus is adapted for solidifying a structure susceptible to instability due to subterranean voids, wherein the grout tube is adapted for insertion into soil and through the subterranean voids.

6. The apparatus of claim 5 wherein the grout tube and supplemental tube are adapted whereby as grout is pumped through the supplemental tube into the grout tube, the supplemental tube is slidably positioned within the grout tube such that the amount of grout dispensed through the apertures of the grout tube into the subterranean void can be regulated by the user.

7. The apparatus of claim 6 wherein the supplemental tube is slidably positioned by raising the supplemental tube vertically through the grout tube.

8. The apparatus of claim 1 wherein the grout tube and supplemental tube are adapted whereby the supplemental tube is capable of being vertically raised within the grout tube while dispensing grout through the supplemental tube.

9. A method of supporting or solidifying a structure which comprises using the apparatus of claim 1.

10. The method of claim 9, the method comprising:

(a) inserting the grout tube vertically into the soil adjacent to the foundation of the structure;

(b) attaching the bracket to the foundation;

(c) inserting the supplemental tube into the grout tube;

(d) adjusting the position of the supplemental tube such that the lower end of the supplemental tube is located at a vertical position within the grout tube at a first height above the closed lower end of the grout tube; and (e) dispensing grout into the supplemental tube whereby grout is dispensed out of the lower end of the supplemental tube, into the grout tube and out of the apertures of the grout tube into the subterranean void.

11. The method of claim 10 further comprising:

(f) raising the supplemental tube such that the lower end of the supplemental tube is located at a vertical position within the grout tube at a second height above the closed lower end of the grout tube;

(g) dispensing grout into the supplemental tube whereby grout is dispensed out of the lower end of the supplemental tube, into the grout tube and out of the apertures of the grout tube into the subterranean void; and (h) repeating steps (f) and (g) until the desired amount of grout has been dispensed or until the subterranean void is substantially filled with grout.

12. The method of claim 9, the method comprising:

(a) attaching the bracket to the foundation;

(b) inserting the grout tube through the bracket and vertically into the soil adjacent to the foundation of the structure;

(c) inserting the supplemental tube into the grout tube;

(d) adjusting the location of the supplemental tube such that the lower end of the supplemental tube is located at a vertical position within the grout tube at a first height above the closed lower end of the grout tube; and (e) dispensing grout into the supplemental tube whereby grout is dispensed out of the lower end of the supplemental tube, into the grout tube and out of the apertures of the grout tube into the subterranean void.

13. The method of claim 12 further comprising:

(f) raising the supplemental tube such that the lower end of the supplemental tube is located at a vertical position within the grout tube at a second height above the closed lower end of the grout tube;

(g) dispensing grout into the supplemental tube whereby grout is dispensed out of the lower end of the supplemental tube, into the grout tube and out of the apertures of the grout tube into the subterranean void; and (h) repeating steps (f) and (g) until the subterranean void is substantially filled with grout.

* * * * *